United States Patent [19]

Igashira et al.

[11] Patent Number: 4,649,887

[45] Date of Patent: Mar. 17, 1987

[54] PUMP FOR SUPPLYING PRESSURIZED FUEL TO FUEL INJECTOR OF INTERNAL COMBUSTION ENGINE

[75] Inventors: Toshihiko Igashira, Toyokawa; Yasuyuki Sakakibara, Nishio; Toru Yoshinaga; Seiko Abe, Okazaki, all of Japan

[73] Assignee: Nippon Soken, Inc., Nishio, Japan

[21] Appl. No.: 689,374

[22] Filed: Jan. 7, 1985

[30] Foreign Application Priority Data

Jan. 12, 1984 [JP] Japan ..... 59-2559
Jun. 11, 1984 [JP] Japan ..... 59-118110
Jul. 19, 1984 [JP] Japan ..... 59-148525

[51] Int. Cl.[4] ..... F02M 39/00
[52] U.S. Cl. ..... 123/508; 123/495
[58] Field of Search ..... 123/495, 509, 508, 507, 123/446, 447

[56] References Cited

U.S. PATENT DOCUMENTS 1,677,202 7/1928 Olsen ..... 123/508

FOREIGN PATENT DOCUMENTS 3239115 5/1983 Fed. Rep. of Germany ..... 123/508
57-12859 3/1982 Japan ..... 123/508

*Primary Examiner*—Carl Stuart Miller
*Attorney, Agent, or Firm*—Cushman, Darby & Cushman

[57] ABSTRACT

A pump including a plunger slidably disposed in a pump body, a transmitting member connected to the plunger, a coil spring which urges the plunger, and a cam urging the plunger against the coil spring. The plunger defines a pump chamber in the pump body. The coil spring urges the plunger in a direction such that the plunger contracts the pump chamber. The cam rotates in synchronization with the rotation of the engine and engages with the transmitting member for part of the cycle of the rotation of the engine so that the plunger increases the volume of the pump chamber. The cam releases the plunger in the remaining cycle of the rotation of the engine to allow the coil spring to urge the plunger so that the plunger displaces in a direction to reduce the volume of the pump chamber.

11 Claims, 9 Drawing Figures

PUMP FOR SUPPLYING PRESSURIZED FUEL TO FUEL INJECTOR OF INTERNAL COMBUSTION ENGINE

BACKGROUND OF THE INVENTION

1. Field of the Invention

The present invention relates to a fuel supply pump in a system for injecting pressurized fuel to an internal combustion engine such as a diesel engine.

2. Description of the Related Art

For controlling the quantity of fuel discharged from a fuel injector with high precision so as to most efficiently run an engine, it is advantageous to use electrical control means to open and close the fuel injector. For electrical controlling, it is preferable that the object under control be as simple as possible. Accordingly, a conventional electronically controlled fuel injecting system is constructed in such a manner that the fuel injector is supplied with highly pressurized fuel and a valve provided in the injector is simply opened or closed by the electrical control means.

Thus, in the conventional system, a pressure regulator is provided to adjust the pressure of the fuel to a predetermined value. Usually, a relief mechanism is provided in the pressure regulator to relieve residual fuel so that the pressure regulator obtains and maintains a constant pressure value.

In a system including a relief mechanism, however, there is a problem in that air bubbles are caused in the fuel due to the rise of fuel temperature caused by friction of the fuel during relief thereof. Further, power loss of the pump is caused because the pump must be able to discharge the relieved fuel as well.

SUMMARY OF THE INVENTION

Accordingly, the present invention has as its object to provide a pump which discharges fuel under a substantially constant pressure so as to eliminate the need for a pressure regulator and a relief mechanism in the fuel injection system.

According to the present invention, there is provided a pump including: a pump body having a bore, a plunger slidably disposed in the bore, urging means pressing the plunger, and a cam which can displace the plunger against the urging means. The plunger and the bore form a pump chamber which expands and contracts according to the displacement of the plunger in the bore. The pump chamber is connected to the fuel injector and holds fuel to be supplied to the fuel injector. The pump chamber sucks fuel from a reservoir when increasing in volume and discharges fuel when decreasing in volume, so that pressurized fuel is supplied to the fuel injector. The plunger is provided with a transmitting member engagable with the cam. The urging means urges the plunger in a direction such that the plunger reduces the volume of the pump chamber. The urging means has means for causing a substantially constant force. The cam rotates in synchronization with a rotation of the engine. The cam engages with the transmitting member for part of the cycle of rotation of the engine so that the plunger increases the volume of the pump chamber. The cam releases the plunger in the other part of the cycle of the rotation of the engine to allow the urging means to urge the plunger so that the plunger displaces in a direction to reduce the volume of the pump chamber.

BRIEF DESCRIPTION OF THE DRAWINGS

The present invention will be better understood from the ensuing description made, by way of example, of the embodiments of a pump according to the present invention with reference to the accompanying drawings, wherein.

DE

DESCRIPTION OF THE PREFERRED EMBODIMENTS

Figure 1:
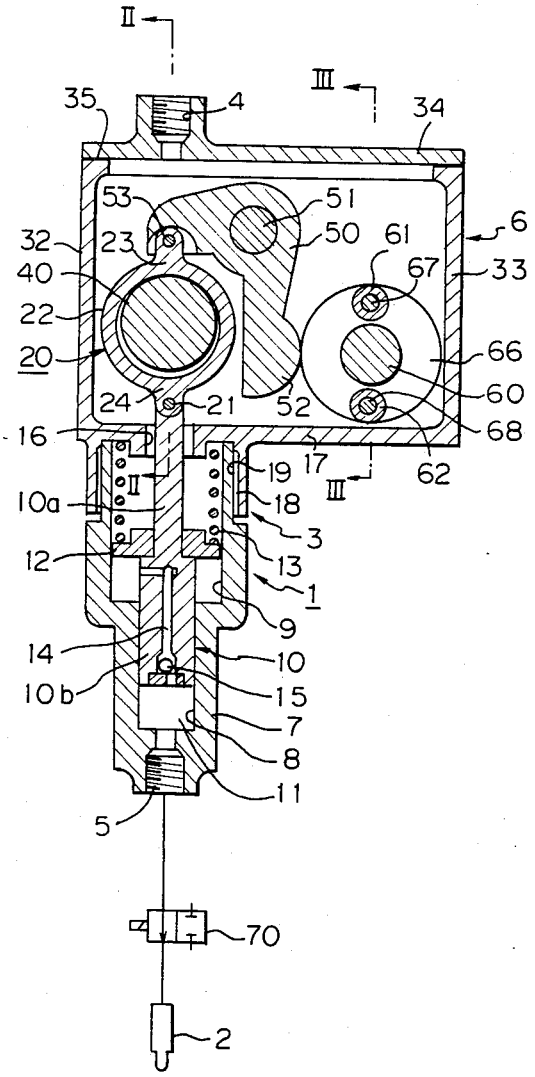
FIG. 1 is a sectional view of a first embodiment of the present invention in a condition in which the plunger is fixed by the camshaft.

In the first embodiment, shown in FIGS. 1 through 7, a pump 1 for supplying pressurized fuel is provided in a fuel control system of an internal combustion engine and serves as an accumulator. The pump 1 is driven in synchronization with the rotation of the internal combustion engine to supply 200 kg/cm$^2$ pressurized fuel to a fuel injector 2 every injection of the fuel injector 2. During operation of the engine, fuel of a pressure of 0.3 to 2 kg/cm$^2$ is supplied to the fuel supply pump 1 from a primary pump (not shown). This fuel flows into the pump 1 through an inlet port 4 formed in a pump body 3. The fuel is pressurized and discharged from an outlet port 5 formed in the pump body 3 to be supplied to the fuel injector 2.

The pump body 3 includes a first casing 6 and a second casing 7. The first casing 6 has a box shape, while the second casing 7 is a stepped tube which has a large diameter portion and a small diameter portion. The pump body 3 is constructed by threadingly fitting a male threaded part 18 formed at a top portion of the second cylinder 7 to a female threaded part 19 formed at a bottom portion of the first casing 6.

The second casing 7 is provided with a stepped bore, that is, is formed with a small diameter bore 8 and a large diameter bore 9. A plunger 10 is slidably disposed in the small diameter bore 8, so that an end surface of the plunger 10 and an inner surface of the small diameter bore 8 form a pump chamber 11, which enlarges and contracts in volume according to the displacement of the plunger 10 in the bore 8. The outlet port 5 directly communicates with the pump chamber 11. The plunger 10 extends into the large diameter bore 9 and is formed with a small diameter rod 10*a* on the portion located in the bore 9, an annular retainer 12 being fitted on the rod 10*a* in the large diameter bore 9. A coil spring 13 is provided between the retainer 12 and a bottom plate 17 of the first casing 6, so that the coil spring 13 presses the retainer 12 to a stepped portion formed between the small diameter rod 10*a* and a large diameter rod 10*b*. The spring 13 urges the plunger 10 through the retainer 12 in a direction such that the plunger 10 reduces the volume of the pump chamber 11. A passage 14 is formed in the large diameter rod 10*a* of the plunger 10 and connects the large diameter bore 9 and the pump chamber 11. That is, one end opening of the passage 14 faces the pump chamber 11, while the other end opening of the passage 14 faces the large diameter bore 9. A check valve 15 provided in the passage 14 allows only a flow directed from the large diameter bore 9 to the pump chamber 11. The large diameter bore 9 communicates with the space in the first casing 6, so that the bore 9 is filled with fuel of a pressure of 0.3 to 2 kg/cm$^2$ during operation of the engine and is filled with fuel of atmospheric pressure during suspension of operation.

As described above, the pump chamber 11 is connected to the fuel injector 2 and reserves fuel to be supplied to the fuel injector 2. The pump chamber 11 sucks fuel from a reservoir (not shown) when increasing in volume and discharges the fuel when reducing in volume so that pressurized fuel is supplied to the fuel injector 2.

Figure 2:
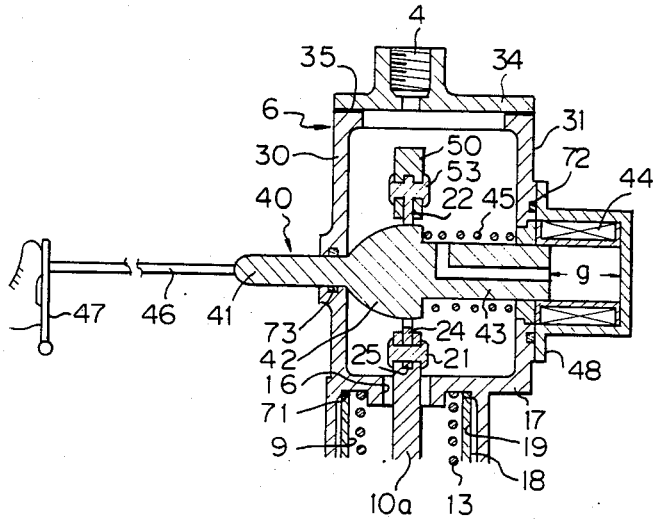
FIG. 2 is a sectional view along line II—II of FIG. 1.

The rod 10*a* formed on the plunger 10 protrudes into the first casing 6 through a hole 16 which is formed in the bottom plate 17 and has a diameter larger than the rod 10*a*. An annular hanger 20 is connected to the end portion of the rod 10*a* by a rivet 21. The hanger 20 is composed of a ring 22 and two projections 23, 24 which are formed on the upper and lower portions of the ring 22. The rivet 21 passes through the projection 24 and the rod 10*a*. As shown in FIG. 2, a notch 25 extending over the width of the rod 10*a* is formed in the end portion of the rod 10*a*, the projection 24 being inserted in the notch 25 to be fixed by the rivet 21, so that the hanger 20 is swingable about the rivet 21, which is the fulcrum.

The first casing 6 includes the bottom plate 17, side plates 30, 31, 32, 33, and a cover plate 34. The side plates 30 and 31 are located at opposed positions. The side plates 32 and 33 are similarly located. The bottom plate 17 and the side plates 30, 31, 32, 33 are formed as one body by aluminum pressure die casting, etc., while the cover plate 34 is formed separately from the bottom plate and the side plates, the cover plate 34 being fixed to the side plates 30, 31, 32, 33 with a gasket 35 by, e.g., bolts. The inlet port 4 is formed in the cover plate 34.

Members such as a hanger cam shaft 40, a lever 50, and a lever camshaft 60 are housed in the first casing 6 besides the hanger 20.

The lever 50 is pivotably supported to a lever shaft 51, both ends of which are fixed to the side plates 30, 31. The lever 50 is a bell-crank, one end of the lever 50 being swingably connected to the projection 23 of the hanger 20 through a rivet 53, the other end being formed with a semi-circular cam follower 52. The cam follower 52 of the lever 50 is engagable with cam rollers 61, 62 provided on the camshaft 60, as described later. That is, the point of force of the lever 50 is the cam follower 52, and the point of action of the lever 50 is the rivet 53.

Figure 3:
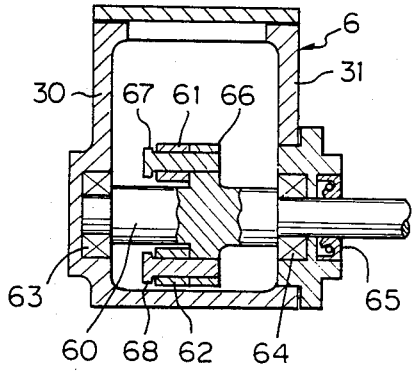
FIG. 3 is a sectional view along line III—III of FIG. 1.

As shown in FIG. 3, the lever camshaft 60 is rotatably supported by bearings 63, 64, which are provided on the side plates 30, 31, respectively, and projects from the side plate 31 through the oil seal 65. The lever camshaft 60 is connected to a crankshaft of the internal combustion engine in such a manner that the lever camshaft 60 is driven in synchronization with the rotation of the engine. In the first casing 6, a flange 66 is formed on the lever camshaft 60, and the cam rollers 61, 62 are rotatably supported to the flange 66 by two pins 67, 68, respectively. These cam rollers 61, 62 are situated parallel to the center axis of the lever camshaft 60 at equal distances therefrom and at positions 180° about the axis. The cam rollers 61, 62 do not rotate about their own axis, but about the axis of the lever camshaft 60, so that the cam rollers 61, 62 contact the cam follower 52 to press it. As a result, the rivet 53, which is a point of action of the lever 50, pulls up the hanger 20 against the coil spring 13.

As shown in FIG. 2, the hanger camshaft 40 is provided in such a manner as to pass through both the side plates 30, 31 and passes through the ring 22 of the hanger 20 in the first casing 6. The hanger camshaft 40 has a rod shape of a diameter varying along the axial direction and comprises a small diameter portion 41, a cam 42, and an armature 43 from the left side to the right side of the drawing. The small diameter portion 41 protrudes to the outside of the first casing 6, while the armature 43 can be inserted in a solenoid 44 provided outside of the first casing 6. The hanger camshaft 40 is supported by the first casing 6 so as to move to-and-fro along the axis thereof. The hanger 20 is freed from the hanger camshaft 40 when the small diameter portion 41 passes through the ring 22 of the hanger 20, so that the plunger 10 can move up and down from the lower position to the upper position. To the contrary, the hanger 20 is suspended by the hanger camshaft 40 to be stopped at the upper position when the cam 42 engages with the ring 22 of the hanger 20.

The cam 42 has a shell shape or approximately semi-spherical shape, connects to the small diameter portion 41 at the spherical portion, and connects to the armature 43 at the plane surface portion. The diameter of the armature 43 is smaller than the maximum diameter of the cam 42. A coil spring 45 is provided around the armature 43, the force of the spring 45 acting between the plane surface portion of the cam 42 and the side plate 31 so that the camshaft 40 is urged toward the left side of FIG. 2. Even if the camshaft 40 moves toward the left side of the drawing by the coil spring 45, the camshaft 40 is stopped at the position where the cam 42 contacts the side plate 30. In this condition, the maximum diameter portion of the cam 42 passes through the ring 22 of the hanger 20.

The right end of a push-rod 46, linked with an accelerator pedal 47, contacts the left end of the small diameter portion 41. The push-rod 46 acts in such a manner that the camshaft 40 moves toward the right side according to a magnitude of stroke of the acceleration pedal 47. The push-rod 46 is not fixed to the acceleration pedal 47 nor the small diameter portion 47, but is supported by a supporting mechanism (not shown). Instead of the push-rod 46, a link mechanism may be provided to transmit an operating force of the accelerator pedal 47 to the camshaft 40. In this case, a force acting on the camshaft 40 to move it toward the left side must not be caused when the stroke of the accelerator pedal 47 becomes small. The push-rod should not be fixedly connected to the small diameter portion 41, but is linked with the small diameter portion 41.

When the camshaft 40 moves toward the right side of the drawing by receiving the operating force of the accelerator pedal 47, the maximum displacement of the camshaft 40 is decided by the solenoid 44 and the armature 43. That is, when the armature 43 moves to the right side in the solenoid 44 so that a gap g becomes zero, the rightward movement of the camshaft 40 stops.

The solenoid 44 is constructed to receive electric current when a key switch of the engine is turned on. The solenoid 44 is constructed such that, while it does not exert a force sufficient to draw the armature 43 against the coil spring 45 from the position where the gap g is maximum to the position where the gap g is zero by application of an electric current, it exerts enough of a force to hold the armature 43 at the position when the gap g is zero. This is because the attracting force of a solenoid is inversely proportional to the square of the dimension of a gap g. In this embodiment, the ring 22 of the hanger 20 engages with the maximum diameter portion of the cam 42 when the gap g is maximum.

Referring to FIG. 2, a gasket 71 prevents fuel from leaking from the threadingly fitting portion of the threaded part 18, 19, and an O-ring 72 prevents fuel from leaking from the flange 48, which is the portion where the solenoid 44 is connected to the side plate 30. An O-ring 73 prevents fuel flowing on the small diameter portion 41 of the camshaft 40 from leaking from the side plate 30.

Referring to FIG. 1, a solenoid valve 70 opens or closes a passage communicating the feed pump 1 and the fuel injector 2. When the valve 70 opens the passage, the fuel injector 2 can inject fuel to the combustion chamber. The injection is carried out every combustion of the engine, the fuel volume at each injection being controlled by the period of opening of the solenoid valve 70.

This embodiment device constructed above operates as follows.

Figure 4:
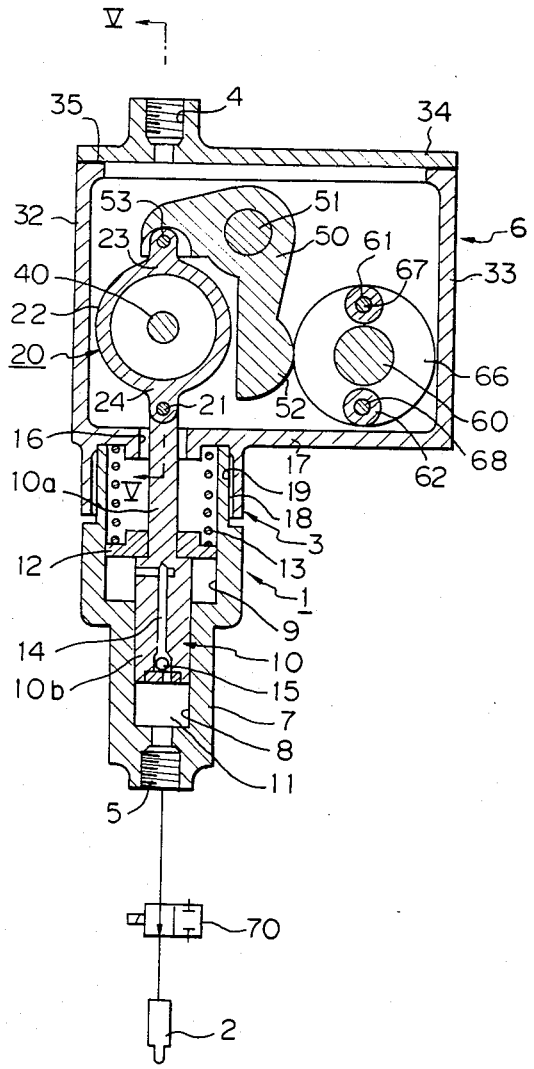
FIG. 4 is a sectional view of the first embodiment in the condition in which the plunger is not fixed by the camshaft.
Figure 5:
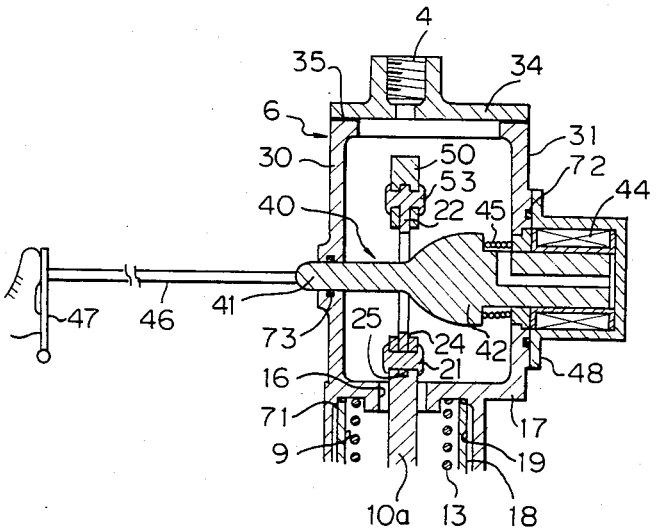
FIG. 5 is a sectional view along line V—V of FIG. 4.
Figure 6:
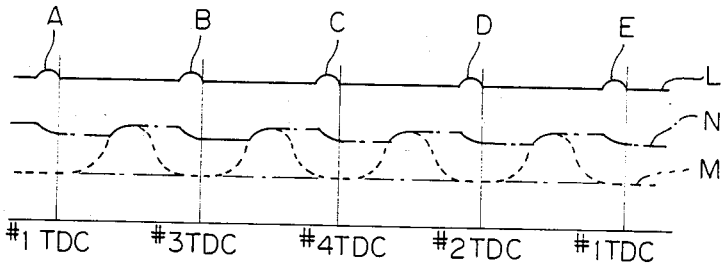
FIG. 6 is a graph showing an operation of the first embodiment.

First, the operation of the fuel feed pump 1 in an engine operating condition will be described referring to FIGS. 4, 5, and 6. FIG. 6 shows the operation in the case where the internal combustion engine is a four-cycle diesel engine and the fuel injector 2 is provided for each cylinder.

The solenoid valve 70 is also provided for each cylinder and, at a crank-angle near the top dead center (TDC) in each combustion stroke of each cylinder (once per two rotations of the engine), opens a valve during a period, for example 2 msec, proportional to the stroke of the accelerator pedal 47, so that the fuel injector 2 carries out fuel injection. The process of this fuel injection, that is, the transition of the rate of injection by time is indicated by a solid line L in FIG. 6. Meanwhile, the cam rollers 61, 62 alternately come to positions applying force to the lever 50 at the middle of the interval between fuel injections of either cylinder. Therefore, the cam rollers 61, 62 engage with the lever for part of the cycle of the rotation of the engine so that the plunger 10 increases the volume of the pump chamber 11 and so that the cam rollers 61, 62 release the lever 50 in the remaining cycle of the rotation of the engine to allow the spring 13 to urge the plunger 10 to be displaced in a direction to reduce the volume of the pump chamber 11. This process is shown by a broken line M in FIG. 6. This broken line M indicates the cam lift, that is, shows the displacement by which the plunger 10 would be pulled up if the plunger 10 were located at the lowest position. In fact, however, the plunger 10 moves downward only to the position where the pump chamber 11 is reduced by the fuel volume consumed by injection. As the fuel volume is sufficiently small in comparison with the cam lift (for example 1/10 even in the case of maximum volume injection), the plunger 10 is moved upward in a region near to the top portion of the cam lift. Therefore, deflection of the spring 13 is relatively small, so that the spring 13 always causes substantially a constant force. This process is shown by a chained line N in FIG. 6.

When the plunger 10 is moved upward, fuel is sucked into the pump chamber 11 from the large diameter bore 9 through the passage 14 and the check valve 15. After the plunger 10 is pulled up by the cam roller 61 or 62 so that the pump chamber 11 finishes the suction stroke, when the cam roller 61 or 62 separates from the lever 50, the plunger 10 is pressed downward by action of the spring 13, so that fuel in the pump chamber 11 is pressurized to about 200 kg/cm$^2$ and is maintained there until the next fuel injection. The volume of the pump chamber 11 is reduced by fuel injection. The pressure in the pump chamber 11 may drop to 190 kg/cm$^2$ in the case of full injection.

If the key switch is turned off during operation of the engine, the solenoid valve 70 continues in a closed condition, so that the fuel supply from the fuel injector 2 is stopped. At the same time, the solenoid 44 is deenergized, so that the camshaft 40 moves toward the left side by the action of the spring 45. Even if the fuel supply is stopped, the internal combustion engine rotates several cycles by inertia, whereby the lever camshaft 60 acts so that the hanger 20 is pulled up at every action of the level camshaft 60. Thus, at the moment that the hanger 20 is pulled up to the highest position, the hanger camshaft 40 held at the right position by the spring 45 moves toward the left side, as shown in FIGS. 1 and 2, so that the maximum diameter portion of the cam 42 engages with the ring 22 so that descent of the plunger 10 is stopped. Thus, the pump chamber 11 remains in maximum volume condition, and the pressure of the fuel is kept at about atmospheric pressure, the same as the pressure in the large diameter bore 9, whereby fuel leakage from the fuel injector 2 is prevented.

When starting the internal combustion engine, the key switch is turned on and the accelerator pedal 47 is depressed to the full stroke, so that the camshaft 40 is pressed by the push-rod 46 to move right. The armature 43 is kept by action of electromotive force of the solenoid 44 at the position where the gap g is substantially zero. As the ring 22 of the hanger 20 is passed through the small diameter portion 41 to be released from the hanger camshaft 40, the plunger 10 moves downward so that, in a moment, a fuel pressure of about 200 kg/cm$^2$ is generated in the pump chamber 11. By turning the engine starter in this condition, the internal combustion engine starts. Subsequent to this, the camshaft 40 will not move even with a small depression of the accelerator pedal.

Figure 7:
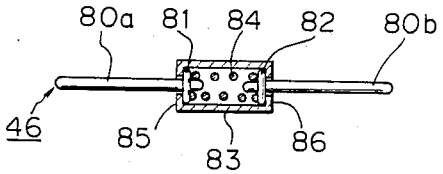
FIG. 7 is a partially sectional side view of a push-rod.

In the above embodiment, while the solenoid 44 functions as a stopper provided for limiting the full stroke of the accelerator pedal 47, it is preferable that the push-rod 46 have the buffer mechanism shown in FIG. 7. In FIG. 7, the push-rod 46 is divided into two parts **80*a* and 80*b*. A flange portion 81 is formed on the end of the left push-rod 80*a*, and a flange portion 82 is formed on the end of the right push-rod 80*b*, both flange portions 81, 82 are housed in a cylindrical casing 83. These flange portions 81, 82 are engagable with end portions 85, 86 of the cylindrical casing 83, respectively, a spring 84 being provided between these flange portions 81, 82. Therefore, when the accelerator pedal 47 is depressed and the stroke thereof becomes large, the spring 84 is compressed so that a pressing force is transmitted to the camshaft 40**.

Figure 8:
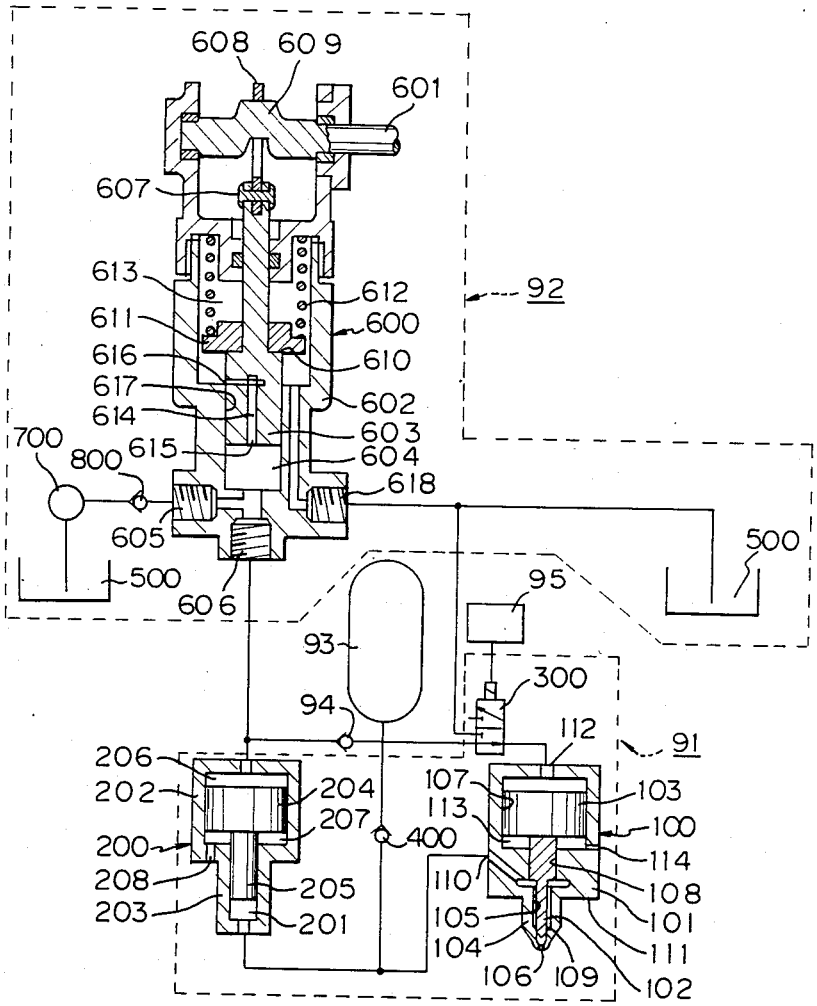
FIG. 8 is a sectional view of a second embodiment of the present invention.

FIG. 8 shows a second embodiment of the present invention. This embodiment includes an injecting mechanism 91, a pressure generating mechanism 92, and a pressure accumulating mechanism 93.

The injecting mechanism 91 has a fuel injector 100, a step piston 200, a control valve 300, and a check valve 400. These elements may be accommodated in a single housing or in separate housings connected together for each combustion chamber. In this embodiment, only one injecting mechanism 91 is shown. In the case of a multiple cylinder engine, however the number of injecting mechanisms 91 corresponds to the number of the cylinders.

As described later, the fuel injector 100 injects fuel pressurized by the step piston 200 into a combustion chamber by control of the control valve 300. The fuel injector 100 has a nozzle body 101, a nozzle needle 102, and a control piston 103. The nozzle body 101 is formed with a projecting portion 104 at one end thereof, the projecting portion 104 being formed with a small diameter bore 105 therein and being opened to an injecting port 106 at an end thereof. The control piston 103 is slidably supported in a large diameter bore 107 of the nozzle body 101. The nozzle needle 102 is slidably supported in a medium diameter bore 108 formed between the large and small diameter bores 107, 105, one end of the needle 102 protruding into the large diameter bore 107 to contact with the control piston 103, and the other end of the needle 102 extending into the small diameter bore 105 to be able to sealingly contact a seat surface 109 near to the injecting port 106.

There is a clearance between the nozzle needle 102 and the small diameter bore 105 allowing passage of fuel. A feed port 110 formed in a cylinder wall of the nozzle body 101 communicates with the injecting port 106 through the clearance and is shut off therefrom when the nozzle needle 102 sits on the seat surface 109. The feed port 110 communicates with a pressure chamber 201 of the step piston 200, as described later, and is supplied with fuel from the pressure chamber 201. Therefore, fuel is injected from the injecting port 106 when the nozzle needle 102 moves upward to separate from the seat surface 109, and fuel injection is stopped when the nozzle needle 102 moves downward to sit on the seat surface 109. The nozzle needle 102 always contacts the control piston 103, so that the needle 102 moves downward when being pressed down by the control piston 103 and is urged upward by fuel pressure acting on a step portion 111 to move upward when the pressing force transmitted from the control piston 103 becomes relatively small.

The control piston 103 moves up and down due to pressure of control oil supplied through a control port 112 formed on a top portion of the nozzle body 101. This pressure of control oil is controlled by the control valve 300, which is a solenoid valve. The control valve 300 communicates with the accumulating mechanism 93 in the open position shown in the drawing, so that a high pressure of fuel is transmitted to the valve 300 from the accumulating mechanism 93. To the contrary, when the control valve 300 is switched to the closed position, the control port 112 communicates with a fuel reservoir 500 of the pressure generating mechanism 92, so that the pressure of control oil drops. The control valve 300 is switched by a computer 95. It is to be noted that a middle chamber 113 formed between the control piston 103 and the nozzle needle 102 communicates with the outside of the nozzle body 101 through a drain port 114.

The housing of the step piston 200 is composed of a large diameter cylinder 202 and a small diameter cylinder 203. A large diameter piston 204 is slidably disposed in the large diameter cylinder 202, and a small diameter piston 205 is slidably disposed in the small diameter cylinder 203. The small diameter piston 205 projects into the large diameter cylinder 202 for constant contact with the large diameter piston 204. These pistons 204, 205 move up and down coaxially with each other. While these pistons 204, 205 are formed separately in this embodiment, they may also be formed as one body. In the small diameter cylinder 203, the pressure chamber 201 is defined by the small diameter piston 205, the volume of the pressure chamber 201 being varied by the piston 205. The pressure chamber 201 is connected to the accumulating mechanism 93 through a check valve 400. Fuel supplied from the accumulating mechanism 93 is pressurized by action of the small diameter piston 205 for supplying to the feed port 110 of the fuel injector 100. On the other hand, a control oil pressure chamber 206 is formed at the upper portion of the large diameter piston 204 in the large diameter cylinder 202. The control oil pressure chamber 206 communicates with a high pressure feed pump 600 of the pressure generating mechanism 92, described later. A middle chamber 207 formed under the large diameter piston 204 communicates with the outside of the housing through a drain port 208.

The pressure generating mechanism supplies pressurized fuel to the injecting mechanism and includes the reservoir 500, a low pressure feed pump 700, a check valve 800, and a high pressure feed pump 600. Only one each of these elements is necessary even in the case of a multiple cylinder engine.

The high pressure feed pump 600 carries out pump action by a camshaft 601 rotating in synchronization with the rotation of the engine. The pump 600 pressurizes fuel fed from the fuel reservoir 500 by the low pressure feed pump 700 and supplies the fuel to the injecting mechanism 91. For this purpose, a plunger 603 is slidably disposed in a housing 602. The plunger 603 is driven by the camshaft 601 to move to-and-fro, so that the plunger 603 pressurizes a pump chamber 604 formed under this plunger 603. The pump chamber 604 is connected to the low pressure feed pump 700 through the check valve 800 and an inlet port 605 formed in the housing 602 and is connected to the control oil pressure chamber 206 of the step piston 200 through an outlet port 606. Therefore, fuel supplied to the pump chamber 604 by the low pressure feed pump 700 through the check valve 800 is pressurized by the plunger 604 to be discharged from the outlet port 606. The low pressure feed pump 700 is an electrically driven vane pump. The low pressure feed pump 700 can pressurize fuel in the fuel reservoir 500 to a pressure of about 5 $kg/cm^2$ to feed this fuel to the high pressure feed pump 600, while the high pressure feed pump 600 can pressurize fuel in the pump chamber 604 to a pressure of about 200 $kg/cm^2$.

The top end of the plunger 603 projects from the housing 602, an annular hanger 608 being swingably supported on the projection portion. A cam 609 of the camshaft 601 engages with the inside of the hanger 608. On the one hand, a step 610 is formed at the center portion of the plunger 603, a retainer 611 engaging with the step 611, a spring 612 being provided between the retainer 611 and an upper surface of the housing 602. While the spring 612 urges the plunger 603 downward with the retainer 611, the cam 609 can pull up the plunger 603 against the spring 612.

The cam 609 is constructed in such a manner that the plunger 603 carries out an intake stroke halfway between injections by the fuel injector 100. The number of projecting portions of the cam 609 is determined such that an intake stroke is carried out at every interval of each injection no matter which fuel injector has injected fuel, in case a plurality of fuel injectors are provided. In this drawing, only one projecting portion of the cam 609, is shown, which would normally indicate the case of a single-cylinder internal combustion engine.

When the camshaft 601 rotates in the hanger 608 and the projecting portion engages with the upper portion of the inner surface of the hanger 608, the plunger 603 is pulled up against the spring 612, so that fuel is supplied to the pump chamber 604 from the low pressure feed pump 700 and the control oil pressure chamber 206 of the step piston 200. To the contrary, when the projecting portion of the cam 609 is released from the inner surface of the hanger 608, the plunger 603 is pressed by the spring 612 to move downward and carry out an intake stroke.

A spring chamber 613 housing the spring 612 can communicate with the pump chamber 604 through a passage 614 formed in the plunger 603. While one opening 615 of the passage 614 always faces the pump chamber 604, the other opening 616 faces the spring chamber 613 when the plunger 603 is at its highest position, that is, at the end of the intake stroke, and is closed by an inner surface 617 of the housing 602 in the other case. The spring chamber 613 is in constant communication with the fuel reservoir 500 through a drain port 618 formed in the housing 602.

As described above, the outlet port 606 always communicates with the control oil pressure chamber 206 of the step piston 200, so that fuel in the control oil pressure chamber 206 is sucked back to the pump chamber 604 in the intake stroke, and fuel in the pump chamber 604 is pressurized to be fed to the control oil pressure chamber 604 in the discharge stroke. The outlet port 606 discharges fuel pressurized by the pressure accumulating mechanism 93 through the check valve 94 in the discharge stroke.

While the pressure accumulating mechanism 93 is an accumulator or reservoir, it may also be a thick metal pipe connecting the fuel injectors of the cylinders, i.e., a so-called "common-rail". The pressure accumulating mechanism 93 is connected to the pump chamber 201 of the step piston 200 and is also connected to the control port 112 of the fuel injector 100 through the control valve 300.

The second embodiment operates as follows.

When any of the cylinders of the engine fully passes the top dead center of the compression stroke, the camshaft 601 pushes the plunger 603 up against the spring 612 so that the pump chamber 604 carries out the intake stroke. The camshaft 601 releases the plunger 603 well before any cylinder piston comes near the top dead center of the compression stroke. Then, the plunger 603 is urged by the spring 612 to move down, so that fuel in the pump chamber 604 is pressurized to a pressure of about 200 kg/cm$^2$. The pressurized fuel is supplied to the pressure accumulating mechanism 93 and is fed to the pressure control oil chamber 206 of the step piston 200 to act on the large diameter piston 204. In this embodiment, the diameter of the large diameter piston 204 is three times the diameter of the small diameter piston 205, therefore, fuel in the pump chamber 201 is pressurized to a pressure of about 1,800 kg/cm$^2$. The fuel pressurized to 1,800 kg/cm$^2$ is supplied to the feed port 110 of the fuel injector 100 to press the nozzle needle 102 upward (to act in such a manner that the injecting port 106 is opened). However, the nozzle needle 102 will not move up as it is held down by the control piston 103, which has a sufficiently large diameter in comparison to the needle 102. That is, the control piston 103 is subjected to a fuel pressure of about 200 kg/cm$^2$ transmitted from the pressure accumulating mechanism 93 through the control valve 300, and the nozzle needle 102 is pressed down to closely contact the seat surface 109 due to the difference between the pressure receiving areas of the control piston 103 and the nozzle needle 102.

In this condition, when any cylinder piston of the engine reaches a predetermined crank angle just before the top dead center of the compression stroke, the computer 95 switches the control valve 300 corresponding to the cylinder so that the high pressure fuel acting on the control piston 103 is released to the fuel reservoir 500. As a result, the force acting on the top surface of the nozzle needle 102 decreases, so that the nozzle needle 102 moves upward due to pressure acting on the step 111, whereby the injecting port 106 is opened so that fuel of a pressure of 1,800 kg/cm$^2$ is injected into the cylinder. Due to this fuel injection, the large diameter piston 204 and the small diameter piston 205 of the step piston 200 move downward, so that fuel of a pressure of 200 kg/cm$^2$ in the pump chamber 604 of the high pressure feed pump 600 is supplied in the control oil pressure chamber 206 enlarged due to the action of the step piston 200.

After a required volume of fuel injection is finished, the computer 95 switches the control valve again, so that the control piston 103 is subjected to the pressure of 200 kg/cm$^2$ of the pressure accumulating mechanism 93. As a result, the nozzle needle 102 is again pressed down by the control piston 103 to move down and sit on the seat surface 109 to close the injecting port 106, whereby fuel injection is terminated. When the cylinder piston which has carried out the fuel injection sufficiently passes the top dead center of the compression stroke, the camshaft 601 push up the plunger 603 against the spring 612, so that the pump chamber 604 carries out a suction stroke. Then, the pump chamber 604 is supplied with fuel from the control oil pressure chamber 206 of the step piston 200 in addition to the low pressure feed pump 700. Fuel is supplied to the pump chamber 201 of the step piston 200 from the pressure accumulating mechanism 93 through the check valve 400, so that the large diameter piston 204 and the small diameter piston 205 move upward. Meanwhile, when the plunger 602 of the high pressure feed pump 600 sufficiently moves up to come to the return position, the opening 616 faces the spring chamber 613, whereby the pump chamber 614 communicates with the fuel reservoir 500 through the passage 614, the spring chamber 613, and the drain port 618. Therefore, air bubbles in the pump chamber 604 are removed, and fuel in the control oil pressure chamber 206 is discharged.

By repeating the above operation, fuel injection is carried out.

The plunger 603 can be driven by any mechanism which moves to-and-fro in synchronization with the rotation of the engine.

According to the above embodiment, no solenoid valve is necessary for controlling the step piston, so that the construction of the device and software for controlling the device become simpler. Further, as it is unnecessary to provide a relief valve, power loss due to the relief valve is eliminated. Thus, the rise in the oil temperature is restrained and generation of air bubbles is inhibited.

Figure 9:
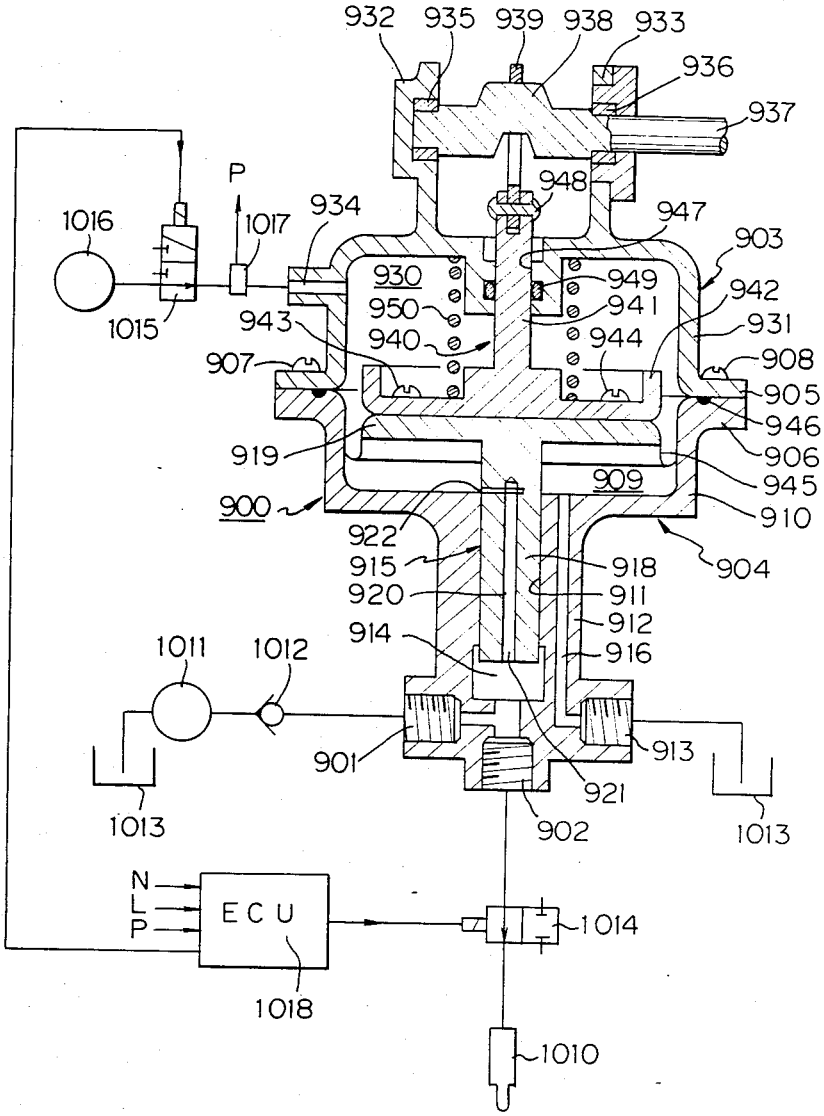
FIG. 9 is a sectional view of a third embodiment of the present invention.

FIG. 9 shows a third embodiment of the present invention. A fuel supply pump 900 is provided in a fuel control system of an internal combustion engine and is operated in synchronization with the rotation of the engine to supply fuel controlled to a constant pressure of 150 to 400 kg/cm$^2$ every injection of a fuel injector 1010. This pump 900 also operates as an accumulator. In operation of the engine, the fuel supply pump 900 is constantly supplied with fuel of a pressure of 0.3 to 2 kg/cm$^2$ from a primary pump 1011 through a check valve 1012. The fuel flows into the pump 900 through an inlet port 901 and is pressurized to be discharged from an outlet port 902 and supplied to the fuel injector 1010.

The pump body of the pump 900 includes an upper casing 903 and a lower casing 904, these casing being connected by screws 907, 908 at flanges 905, 906, respectively. The lower casing 904 is composed of a large diameter portion 910 having a lower diaphragm chamber 909 and a small diameter portion 912 having a cylinder bore 911. At the lower end of the small diameter portion 912 are formed the inlet port 901, communicated with a fuel reservoir 1013 through the primary pump 1011 and a check valve 1012; the outlet port 902, communicated with the fuel injector 1010 through solenoid valve 1014; and a drain port 913, directly communicated with the fuel reservoir 1013. A pump chamber 914 is formed in a lower portion of the cylinder bore 911. The pump chamber 914 communicates with the inlet port 901 and the outlet port 902 and is enlarged and contracted by a plunger 915, described later. The drain port 913 is in constant communication with the lower diaphragm chamber 909 through a passage 916.

The plunger 915 is slidably disposed in the cylinder bore 911. The lower surface of a cylindrical portion of the plunger 915 faces the pump chamber 914. A flange 919 formed on the upper portion of the plunger 915 and having a diameter of about five times that of the cylindrical portion 918 is situated in the lower diaphragm chamber 909. The plunger 915 moves up and down in the drawing to change the volume of the pump chamber 914, so that fuel is pressurized to be supplied to the fuel injector 1010. In the axial portion of the cylindrical portion 918 of the plunger 915, a passage 920 for removing air bubbles in fuel in the pump chamber 914 is formed. One opening 921 of the passage 920 faces the pump chamber 914, and the other opening 922 is formed on a side surface of an upper portion of the cylindrical portion 918, the other opening 922 being usually closed by the cylinder bore 911 and facing the lower diaphragm chamber 909 when the plunger 915 comes to the highest position.

The upper casing 903 includes a shell 931, which has an upper diaphragm chamber 930 and has approximately the same outer diameter of the large diameter portion 910 of the lower casing 904, and a pair of stays 932, 933, which are provided on the upper outside surface of the shell 931. On one side of the shell 931, a pressure control port 934 for introducing highly pressurized air into the upper diaphragm chamber 930 is formed. This control port 934 is connected to an air pump 1016 through solenoid three-way valve 1015. Between the three-way valve 1015 and the control port 934, a pressure sensor sensing air pressure in a tube connecting the three-way valve 1015 and the control port 934 is provided. Meanwhile, the stays 932 and 933 face each other and rotatably support a camshaft 937 by bearings 935, 936. The camshaft 937 is constructed so as to be rotated in synchronization with the crankshaft of the engine. The camshaft 937 has projecting portions 938, the number of which is the same as that of the cylinders of the engine (in the case of a 2 cycle engine) or half that of the cylinders of the engine (in the case of a 4 cycle engine). The projecting portion 938 can engage with an inner surface of a hanger 939 to pull up the plunger 915.

A connecting member 940 is housed in the shell 931 of the upper casing 903. The connecting member 940 includes a rod 941 and a retainer 942 formed on the lower end portion of the rod 941, the retainer 942 being connected to the flange 919 of the plunger 915 by screws 943, 944. A diaphragm 945 is held between the retainer 942 and the flange 919, the outer periphery 946 of the diaphragm 945 being held between the flanges 905, 906 of the casings 903, 904. The rod 941 of the connecting member 940 protrudes to the outside from a hole 947 formed in the center of the upper portion of the shell 931, the annular hanger 939 being pivotably supported on the projecting end by a pin 948. The rod 941 is slidably supported by the hole 947, an 0-ring 949 being provided on a wall surface of the hole 947 for sealing. A coil spring 950 is provided in the upper diaphragm chamber 930, one end of the spring 950 engaging with upper inner surface of the shell 931, and the other end of the spring 950 engaging with an upper surface of the retainer 942, so that the spring urges the plunger 915 downward through the connecting member 940.

That is, the spring 950 acts to such a direction that the volume of the pump chamber 914 is reduced. Air pressure led into the upper diaphragm chamber 930 from the control port 934 acts to the same direction.

The electronic control unit 1018 (ECU), composed of a microcomputer, switches and controls a solenoid valve 1014 and the solenoid three-way valve 1015 according to the engine speed, opening degree L of the accelerator lever, and pressure P in the tube sensed by a pressure sensor 1017.

The valve 1014 is controlled by the ECU 1018 according to the engine speed N and the opening degree L of the accelerator lever to communicate or shut the pump chamber 914 and the fuel injector 1010. The fuel injector 1010 becomes able to inject fuel into the internal combustion engine when communicating with the pump chamber 914. The fuel injection is carried out every combustion of the engine. The volume of fuel at every injection is controlled by a period of opening of the valve 1014 (that is, period of applying electric current), and the timing of fuel injection is controlled by the timing of opening of the valve 1014 (that is, timing of applying electric current).

The three-way valve 1015 is controlled by the ECU 1018 according to the engine speed N to selectively lead the air or compressed air into the upper diaphragm chamber 930. High air pressure is generated by an air pump 1016 and is introduced into the upper diaphragm chamber 930 from the control port 934 through the three-way valve 1015. The three-way valve 1015 connects the air pump 1016 with the control port 934 to lead compressed air into the upper diaphragm chamber 930 when the valve 1015 is supplied with electric current and opens the control port 934 to the atmosphere when the valve 1015 is not supplied with electric current. The ECU 1018 switches and controls the three-way valve 1015 until the pressure indicated by the pressure sensor 1017 becomes the proper value. "Proper value" means the pressure proportional to the square of the engine speed N, for example, 0.4 atmospheres at 1,000 rpm, 1.6 atmospheres at 2,000 rpm, 3.6 atmospheres at 3,000 rpm, and 10 atmospheres at 5,000 rpm. Note that, as air pressure in the upper diaphragm chamber 930 varies according to movement of the plunger 915, it is preferably that the response of the pressure sensor 1017 be not that sensitive or that the output values of the pressure sensor 1017 over the entire stroke of the plunger be averaged by the ECU 1018 and the average value used at the next stroke of the plunger 915.

The third embodiment constructed above operates as follows.

When a key switch of an engine is turned on for starting the engine, the air pump 1016 and the primary pump 1011 start operation, and the ECU 1018 is started. In this condition, the valve 1014 is closed, so that the fuel injector 1010 cannot inject fuel. The three-way valve 1015 opens the upper diaphragm chamber 930 to the atmosphere. Thus, if the engine is started, the camshaft 937 rotates, whereby the projecting portion 938 engages with the hanger 939 to pull up the connecting member 940 against the spring 950 and air pressure. That is, the plunger 915 is pulled up so that the volume of the pump chamber 914 is enlarged, therefore, the suction stroke is carried out so that fuel is supplied to the pump chamber 914 from the primary pump 1011 through the check valve 1012. This fuel overflows into the lower diaphragm chamber 909 through the passage 920 near to the highest position of the plunger 915 (top dead center), so that air bubbles in the pump chamber 914 are removed.

Thus, when the projecting portion 938 of the camshaft 937 releases the hanger 939, the connecting member 940 and the plunger 915 are displaced downward by the force of the spring 950 and air pressure, so that the pump chamber 914 is compressed to carry out the discharge stroke. The force of the spring 950 is set so as to raise the fuel pressure in the pump chamber 914 to 150 kg/cm$^2$. Now, in the discharge stroke, when the piston of any cylinder of the engine comes to the top dead center of the compression stroke, the ECU 1018 applies electric current to a solenoid of the valve 1014 for a constant period (for example, 2 msec) to open the valve 1014, so that the fuel injector 1010 injects fuel.

Thus, if the engine starts and the engine speed is raised, the ECU 1018 controls the three-way valve 1015 so that air pressure corresponding to the engine speed is transmitted to the upper diaphragm chamber 930. That is, the three-way valve 1015 carries out feedback control according to output signals of the pressure sensor 1017 in such a manner that the output signals indicate 0.4 atmosphere at 1,000 rpm, 1.6 atmospheres at 2,000 rpm, 3.6 atmospheres at 3,000 rpm, and 10 atmospheres at 5,000 rpm, for example, so that the upper diaphragm chamber 930 communicates with the air pump 1016 or the upper diaphragm chamber 930 opens to the atmosphere. As the pressure acting area of the diaphragm 945 is 25 times the pressure acting area of the plunger 915 facing the pump chamber 914, the air pressure acting on the diaphragm 945 acts on the plunger 915 by 25 times the air pressure. Therefore, the urging force by the air pressure and the spring 950 act on the pump chamber 914, and the fuel pressure generated in the pump chamber 914 becomes 160 kg/cm$^2$ at 1,000 rpm, 190 kg/cm$^2$ at 2,000 rpm, 240 kg/cm$^2$ at 3,000 rpm, and 400 kg/cm$^2$ at 5,000 rpm, respectively. As a result, regarding the injection period required to inject fuel by a constant volume, for example, while 1.6 msec is required when driving at 1,000 rpm, 1.0 msec is required when driving at 5,000 rpm. In the case of an engine in which fuel is injected in a cylinder, it is necessary that fuel injection be carried out in a short period as the engine is driven at a high speed. On this point, preferably control is carried out in this embodiment.

When the fuel injection is finished, the pump chamber 914 contracts by the volume corresponding to the fuel volume consumed in injection, so that the plunger 915 moves downward corresponding to the volume. The volume of the pump chamber 915 is more than 10 times the fuel volume consumed in injection, therefore, the drop of force of the spring 950 due to the descent of the plunger 915 is very small. After this, when the camshaft 937 pulls up the plunger 915, as the plunger 915 has moved down only by the quantity according to the fuel injection volume, the plunger 915 needs to move up only by the quantity corresponding to the volume. Thus, the work load of the plunger 915 corresponds to the volume of fuel consumed, so that further power is not necessary to drive the pump 900. The pump 900 does not discharge fuel exceeding the volume of fuel consumed, and the pressure of the fuel discharged by the pump 900 is the value decided by the spring force of the spring 950 and the air pressure. Thus, no additional mechanism for relieving fuel is necessary.

The plunger 915 may be any mechanism which moves to-and-fro in synchronization with the rotation of the engine and is not necessarily operated by the camshaft 937. It is preferable that the inner surfaces of the upper casing 903 and the lower casing 904 be formed in a cylindrical shape, and the outer surface of the flange 919 be sealingly slidably contacted with the inner surface. Further, while the spring 950 can be omitted if necessary, the engine can be started without air pressure if the spring 950 is provided.

According to this third embodiment, it is not necessary to provide a relief mechanism, so no air bubbles are generated in the fuel, the temperature of fuel does not rise, and pump loss is substantially reduced.

Although embodiments of the present invention have been described herein with reference to the attached drawings, many modifications and changes may be made by those skilled in this art without departing from the scope of the invention.

We claim:

1. A pump for supplying pressurized fuel to a fuel injector of an internal combustion engine comprising:

a pump body having a bore, a plunger slidably disposed in said bore, said plunger and said bore forming a pump chamber enlarging and contracting according to displacement of said plunger in said bore, said pump chamber being connected to said fuel injector and holding fuel to be supplied to said fuel injector, said pump chamber sucking fuel from a reservoir when increasing in volume thereof and discharging the fuel when reducing in volume thereof so that pressurized fuel is supplied to said fuel injector, said plunger being provided with a transmitting member, means for urging said plunger in a direction that said plunger reduces the volume of said pump chamber, said urging means having means for applying a substantially constant force, said urging means being a pressure supply mechanism supplying highly pressurized air into said pump body, a cam rotating in synchronization with rotation of said engine, said cam engaging with said transmitting member for part of the cycle of rotation of said engine so that said plunger increases the volume of said pump chamber, said cam releasing said plunger in the remaining cycle of rotation of said engine to allow said urging means to urge said plunger so that said plunger displaces in a direction to reduce the volume of said pump chamber.

2. A pump according to claim 1, wherein said pressure supply mechanism supplies highly pressurized air into said pump body when said plunger feeds pressurized fuel to said fuel injector.

3. A pump according to claim 1, wherein said pressure supply mechanism controls pressure of said air in a manner that said pressure increases in proportion to a square of the speed of said engine.

4. A pump according to claim 1, wherein said cam is provided on a crankshaft of said engine.

5. A pump according to claim 1, wherein said transmitting member is a bell-crank swingably supported on said pump body, one end of said bell-crank being connected to one end portion of said plunger, said end portion being situated on an opposite side of said pump chamber, the other end of said bell-crank having a cam follower engagable with said cam.

6. A pump according to claim 1, wherein said transmitting member is a ring swingably supported on one end portion of said plunger, said end portion being positioned on an opposite side of said pump chamber, said cam engaging with an inner portion of said ring.

7. A pump according to claim 1, further comprising means for holding said plunger in a position where said pump chamber is substantially most enlarged.

8. A pump according to claim 7, further comprising a ring connected to one end portion of said plunger, said end portion being positioned on an opposite side of said pump chamber, said holding means comprising;

a solenoid generating electromotive force when an electric current is applied thereto, a camshaft passing through said ring, said camshaft having a large diameter portion which is engagable with said ring and a small diameter portion which is not engagable with said ring, a spring urging said camshaft toward a direction that said camshaft separates from said solenoid, said camshaft, when an electric current is applied to said solenoid, being attracted by said solenoid so that said small diameter portion situates in said ring so that said plunger can move, said camshaft, when an electric current is not applied to said solenoid, being parted from said solenoid so that said large diameter portion engages with said ring so that said plunger is held.

9. A pump according to claim 8, wherein said camshaft is connected to a push-rod linked to an accelerator pedal, said push-rod being composed of a first portion and a second portion, said first portion and said second portion being connected by a spring.

10. A pump according to claim 1, wherein said pump body has a cylinder chamber with a diameter larger than said bore, said plunger having a passage substantially elongated along the axis thereof, said plunger being slidably fitted in said bore and protruding into said chamber, one end opening of said passage facing said pump chamber, the other end opening of said passage facing said cylinder chamber, said other end opening being closed by an inner surface of said bore when said plunger reduces the volume of said pump chamber to some degree.

11. A pump according to claim 1, further comprising a step piston between said pump chamber and said fuel injector, said step piston comprising:

a housing having a large diameter cylinder and a small diameter cylinder, a large diameter piston slidably disposed in said large diameter cylinder, and a small diameter piston slidably disposed in said small diameter cylinder, said large diameter cylinder communicating with said pump chamber, said small diameter cylinder communicating with said fuel injector.

* * * * *